US012325497B2

(12) United States Patent
Amma

(10) Patent No.: US 12,325,497 B2
(45) Date of Patent: Jun. 10, 2025

(54) MARINE VESSEL THAT SUITABLY TRANSMITS RESCUE SIGNAL, AND METHOD FOR CONTROLLING THE SAME

(71) Applicant: YAMAHA HATSUDOKI KABUSHIKI KAISHA, Iwata (JP)

(72) Inventor: Hirofumi Amma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 273 days.

(21) Appl. No.: 18/197,180

(22) Filed: May 15, 2023

(65) Prior Publication Data

US 2023/0373599 A1 Nov. 23, 2023

(30) Foreign Application Priority Data

May 18, 2022 (JP) ..... 2022-081418

(51) Int. Cl.
*B63B 79/40* (2020.01)
*B63B 79/10* (2020.01)
*B63H 21/21* (2006.01)

(52) U.S. Cl.
CPC ..... *B63B 79/40* (2020.01); *B63B 79/10* (2020.01); *B63H 21/213* (2013.01); *B63H 2021/216* (2013.01)

(58) Field of Classification Search
CPC ..... B63B 79/40; B63B 79/10; B63H 21/213; B63H 2021/216; B63C 9/0005
See application file for complete search history.

(56) References Cited

U.S. PATENT DOCUMENTS

| | | | | |
|---|---|---|---|---|
| 4,630,205 | A | 12/1986 | Otaka | |
| 9,193,420 | B2 | 11/2015 | Anma | |
| 10,730,600 | B2 | 8/2020 | Gonring | |
| 2015/0094886 | A1 | 4/2015 | Anma | |
| 2020/0043315 | A1 | 2/2020 | Watanabe | |
| 2020/0255104 | A1* | 8/2020 | Gonring | B63B 79/40 |
| 2020/0262527 | A1 | 8/2020 | Foley | |
| 2020/0388136 | A1 | 12/2020 | Kurata | |
| 2021/0327247 | A1* | 10/2021 | Lim | G08B 21/088 |
| 2023/0008091 | A1* | 1/2023 | Tsubone | H04M 1/72484 |

FOREIGN PATENT DOCUMENTS

| | | | | |
|---|---|---|---|---|
| JP | 2015-067263 | A | 4/2015 | |
| JP | 2020-019424 | A | 2/2020 | |
| JP | 2020-196402 | A | 12/2020 | |
| KR | 20170130251 | A * | 11/2017 | G01P 15/00 |

* cited by examiner

*Primary Examiner* — Russell Frejd
*Assistant Examiner* — Brittany Renee Peko
(74) *Attorney, Agent, or Firm* — Keating & Bennett, LLP

(57) ABSTRACT

A marine vessel to transmit a rescue signal includes a hull, a propulsion force generator to generate a propulsion force to propel the hull, and a controller. In the marine vessel, the controller is configured or programmed to acquire vessel speed information regarding a vessel speed of the hull, and determine whether or not rescue is necessary based on the vessel speed information in a case where operation of the propulsion force generator is stopped.

20 Claims, 8 Drawing Sheets

MARINE VESSEL THAT SUITABLY TRANSMITS RESCUE SIGNAL, AND METHOD FOR CONTROLLING THE SAME

CROSS REFERENCE TO RELATED APPLICATIONS

This application claims the benefit of priority to Japanese Patent Application No. 2022-081418 filed on May 18, 2022. The entire contents of this application are hereby incorporated herein by reference.

BACKGROUND OF THE INVENTION

1. Field of the Invention

The present invention relates to a marine vessel that suitably transmits a rescue signal and a method for controlling the same.

2. Description of the Related Art

Various switches are mounted on a small marine vessel that accommodates one to three people, for example, a small planing boat which navigates by a water jet propulsion device. Such switches include an engine stop switch for stopping an engine. Examples of the engine stop switch include a manual stop switch, a lanyard switch, and an overturned switch (overturned activated switch) (see, for example, Japanese Laid-open Patent Publication (Kokai) No. 2015-067263). The manual stop switch is a switch that stops the engine in response to manual operation. The lanyard switch is a switch that stops the engine in response to disconnection of a lanyard from a hull. The overturned switch is a switch that stops the engine in response to the hull being overturned. A jet propelled watercraft described in Japanese Laid-open Patent Publication (Kokai) No. 2015-067263 is configured to determine whether or not rescue is necessary based on an operation state of at least one of the manual stop switch, the lanyard switch, or the overturned switch, and to transmit a rescue signal in a case where it is determined that rescue is necessary.

In an actual situation, even in a case where the engine is stopped due to operation of the lanyard switch or the overturned switch, when the jet propelled watercraft is navigating at a relatively low speed, a vessel operator who has fallen in the water can quickly return to the jet propelled watercraft, and thus rescue may be unnecessary.

In the jet propelled watercraft described in Japanese Laid-open Patent Publication (Kokai) No. 2015-067263, a rescue signal is transmitted when the engine is stopped regardless of whether or not the vessel operator who has fallen in the water can quickly return to the jet propelled watercraft. Therefore, there is room for improvement in the appropriateness of transmitting a rescue signal.

SUMMARY OF THE INVENTION

Preferred embodiments of the present invention provide marine vessels that each improve the appropriateness of transmitting a rescue signal.

According to a preferred embodiment of the present invention, a marine vessel includes a hull, a propulsion force generator to generate a propulsion force to propel the hull, and a controller configured or programmed to acquire vessel speed information regarding a vessel speed of the hull, and determine whether or not rescue is necessary based on the vessel speed information in a case where operation of the propulsion force generator is stopped.

With the above configuration, even in a case where the operation of the propulsion force generator of the marine vessel is stopped, whether or not rescue is necessary is determined based on the vessel speed information. As a result, it is possible to prevent a determination that rescue is always necessary regardless of the vessel speed when the operation of the propulsion force generator is stopped. For example, according to a preferred embodiment of the present invention, if the vessel speed is relatively low when the operation of the propulsion force generator is stopped, the rescue signal is not transmitted so that the appropriateness of transmitting the rescue signal is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings. However, the configurations described in the following preferred embodiments are merely examples, and the scope of the present invention is not limited by the configurations described in the preferred embodiments. For example, each unit in the present invention can be replaced with a unit having any configuration capable of exhibiting similar functions. In addition, an arbitrary component may be added. Any two or more configurations (features) of the preferred embodiments may be combined.

Figure 1:
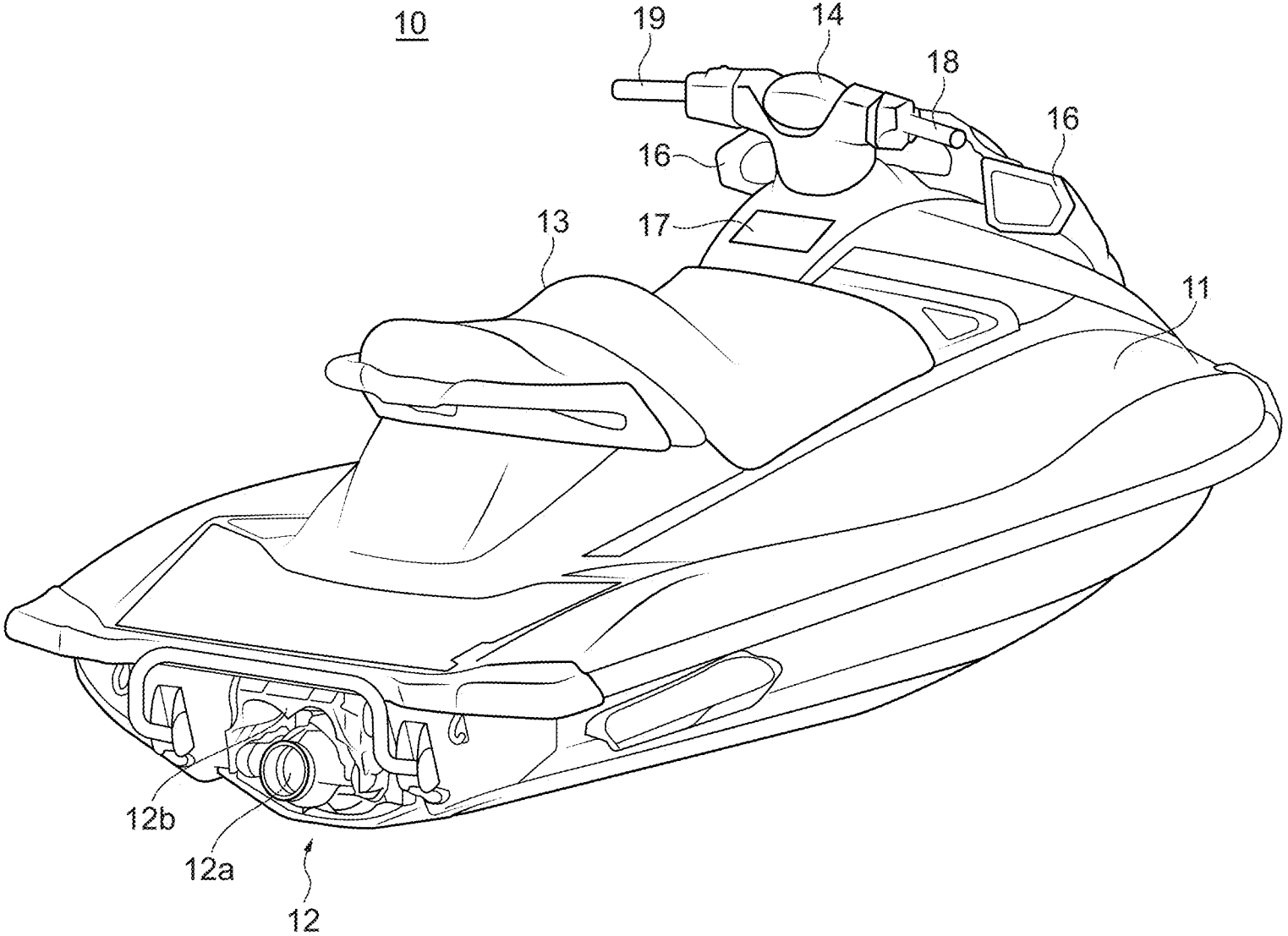
FIG. 1 is a rear perspective view of a marine vessel, which is a saddle-riding type small marine vessel, according to a first preferred embodiment of the present invention.

A first preferred embodiment will be described with reference to FIGS. 1 to 7. Directions (a horizontal direction (front, rear, left, and right), a vertical direction, forward, rearward, and the like) in the description are based on an orientation of a vessel operator on a hull 11. FIG. 1 is a rear perspective view of a marine vessel 10, which is a saddle-riding type small marine vessel, according to the first preferred embodiment of the present invention. The marine vessel 10 illustrated in FIG. 1 is a small saddle-riding type planing boat (personal watercraft (PWC)) having a boarding capacity of three persons or less. The marine vessel 10 includes the hull 11 and a jet propulsion device 12 provided on a stern side of the hull 11. The marine vessel 10 can navigate by using the jet propulsion device 12 as a propulsion force generation unit that generates a propulsion force that propels the hull 11.

The marine vessel 10 includes a seat 13 provided substantially at the center of the hull 11 and on which an occupant including the vessel operator is to be seated, a steering handle 14 provided on a front portion of the hull 11, and an engine 15 provided inside the hull 11. The steering handle 14 can be turned left and right, and a jet nozzle 12*a* of the jet propulsion device 12 is turned left and right in conjunction with the turning of the steering handle 14.

Rearview mirrors 16 are provided on both sides in a forward portion of the steering handle 14. A multifunction meter 17 is provided between the steering handle 14 and the seat 13 as a display unit that displays various types of information regarding the marine vessel 10.

A right handlebar 18 and a left handlebar 19 are provided at right and left ends of the steering handle 14, respectively. During boarding, the vessel operator (passenger) grips the right handlebar 18 and the left handlebar 19 with both hands and operates the steering handle 14, thus turning the jet nozzle 12*a* to steer the marine vessel 10.

Figure 2:
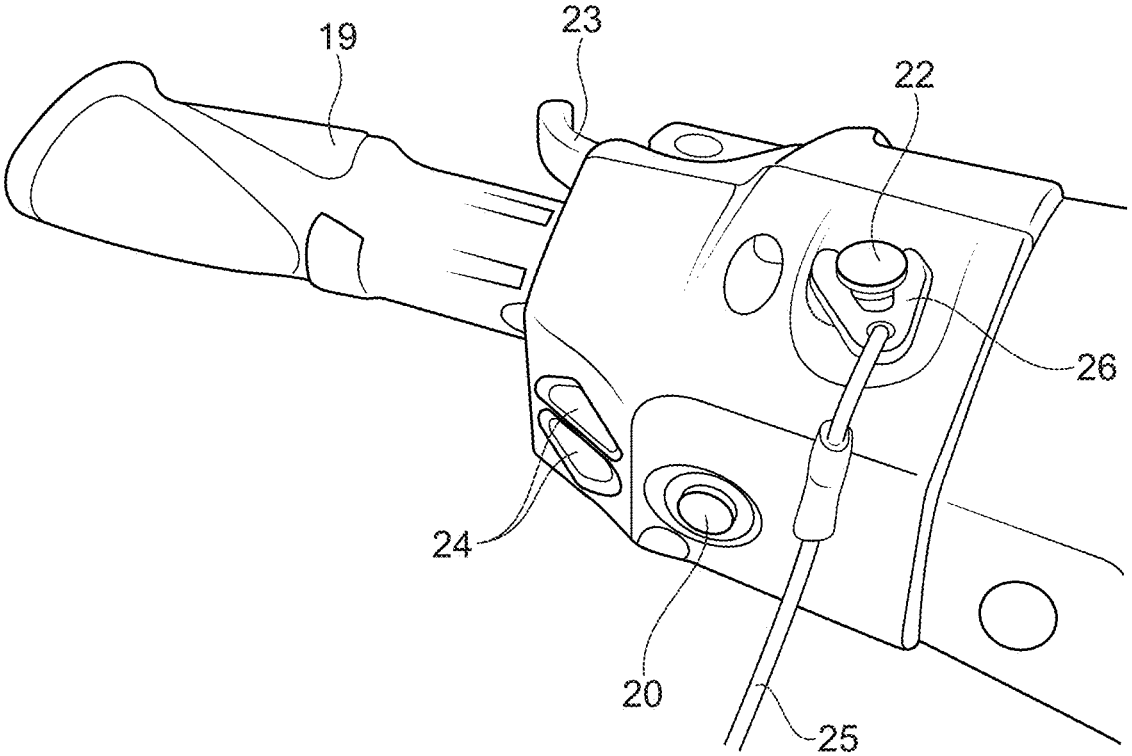
FIG. 2 is a partial enlarged perspective view illustrating a configuration in the vicinity of a left handlebar of the marine vessel illustrated in FIG. 1.
Figure 3:
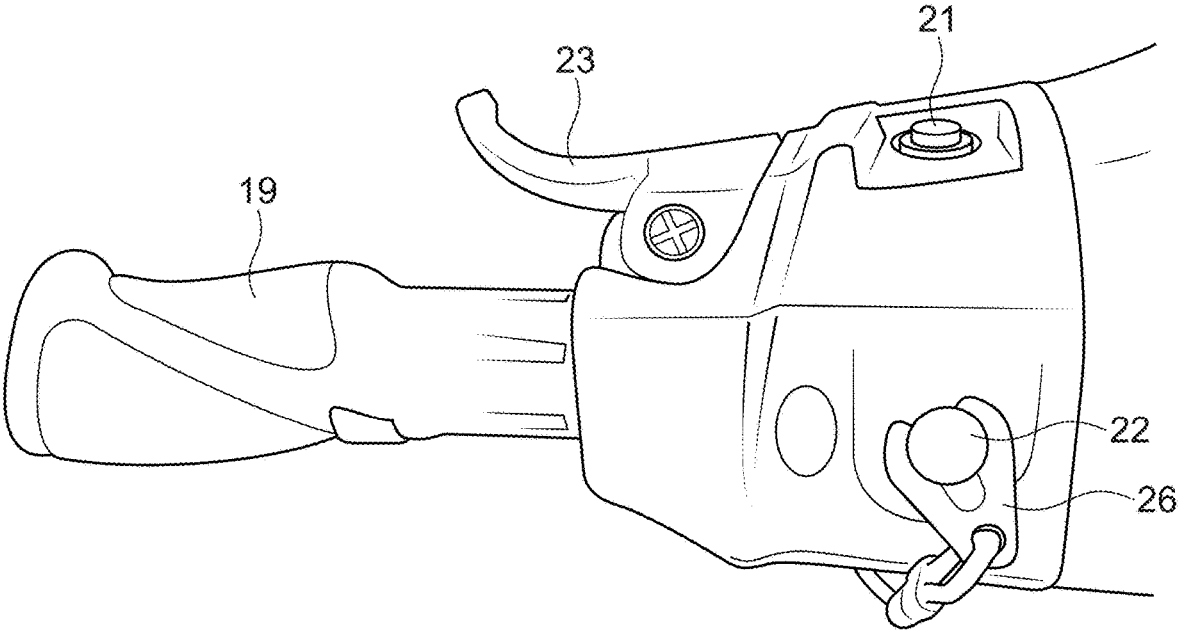
FIG. 3 is a partial enlarged perspective view illustrating a configuration in the vicinity of the left handlebar of the marine vessel illustrated in FIG. 1.

FIGS. 2 and 3 are partial enlarged perspective views illustrating configurations in the vicinity of the left handlebar of the marine vessel 10 illustrated in FIG. 1. FIG. 2 is a view of the left handlebar as viewed from upper rear right. FIG. 3 is a view of the left handlebar as viewed from above. As illustrated in FIGS. 2 and 3, a start switch 20, a stop switch 21, a lanyard switch 22, a reverse lever 23, and a trim switch 24 are provided, as a plurality of operators, in the vicinity of the left handlebar 19. All of these operators are arranged at positions where the operators can be operated by fingers of the left hand when the vessel operator grips the left handlebar 19 with the left hand.

The start switch 20 starts the engine 15 and includes a push button. When the vessel operator presses the start switch 20 to operate the start switch 20, a cell motor (not illustrated) disposed inside the hull 11 operates, and the cell motor starts the engine 15. The stop switch 21 is a manual stop switch that stops the operation of the engine 15 (the jet propulsion device 12) in response to manual operation by the vessel operator, and includes a push button. When the vessel operator presses the stop switch 21 to operate the stop switch 21, the engine 15 is stopped. The lanyard switch 22 urgently stops the operation of the engine 15, and is biased toward the steering handle 14 by an internal biasing component (not illustrated). The lanyard switch 22 is normally engaged with a bifurcated hook 26 provided at one end of a string-like lanyard 25 attached to the wrist or the like of the vessel operator, thus preventing movement toward the steering handle 14.

In response to disconnection of the lanyard 25 (hook 26) from the hull 11, for example, when the vessel operator falls in the water and the hook 26 is detached, the lanyard switch 22 moves toward the steering handle 14 by a biasing force and operates. As a result, an engine emergency stop signal is transmitted to an engine control unit (ECU) 28 to be described below, and the engine 15 is urgently stopped. Note that the lanyard switch 22 is not limited to one connected to the hull 11 via the lanyard 25, and may be one connected to the hull 11 by wireless communication, for example. The reverse lever 23 moves a reverse gate 12*b* covering the jet nozzle 12*a* of the jet propulsion device 12. When the reverse lever 23 is pulled, the reverse gate 12*b* moves in such a way as to cover the jet nozzle 12*a*, and reverses a water flow ejected from the jet nozzle 12*a* forward. As a result, the marine vessel 10 moves backward. The trim switch 24 changes an orientation of the jet nozzle 12*a* in the vertical direction, and is used to adjust a trim (a front-rear inclination angle) of the hull 11.

A throttle lever 27 is provided as an operator in the vicinity of the right handlebar 18. The throttle lever 27 is disposed at a position where the vessel operator can operate the throttle lever 27 with fingers of the right hand when the vessel operator grips the right handlebar 18 with the right hand. For example, the throttle lever 27 is disposed in the vicinity of the right handlebar 18, at a position corresponding to the reverse lever 23 in the vicinity of the left handlebar 19. The throttle lever 27 is a lever switch to adjust the output of the engine 15, and the vessel operator operates the throttle lever 27 by pulling the throttle lever 27. A rotation speed of the engine 15 changes according to the degree of pulling of the throttle lever 27 by the vessel operator.

Figure 4:
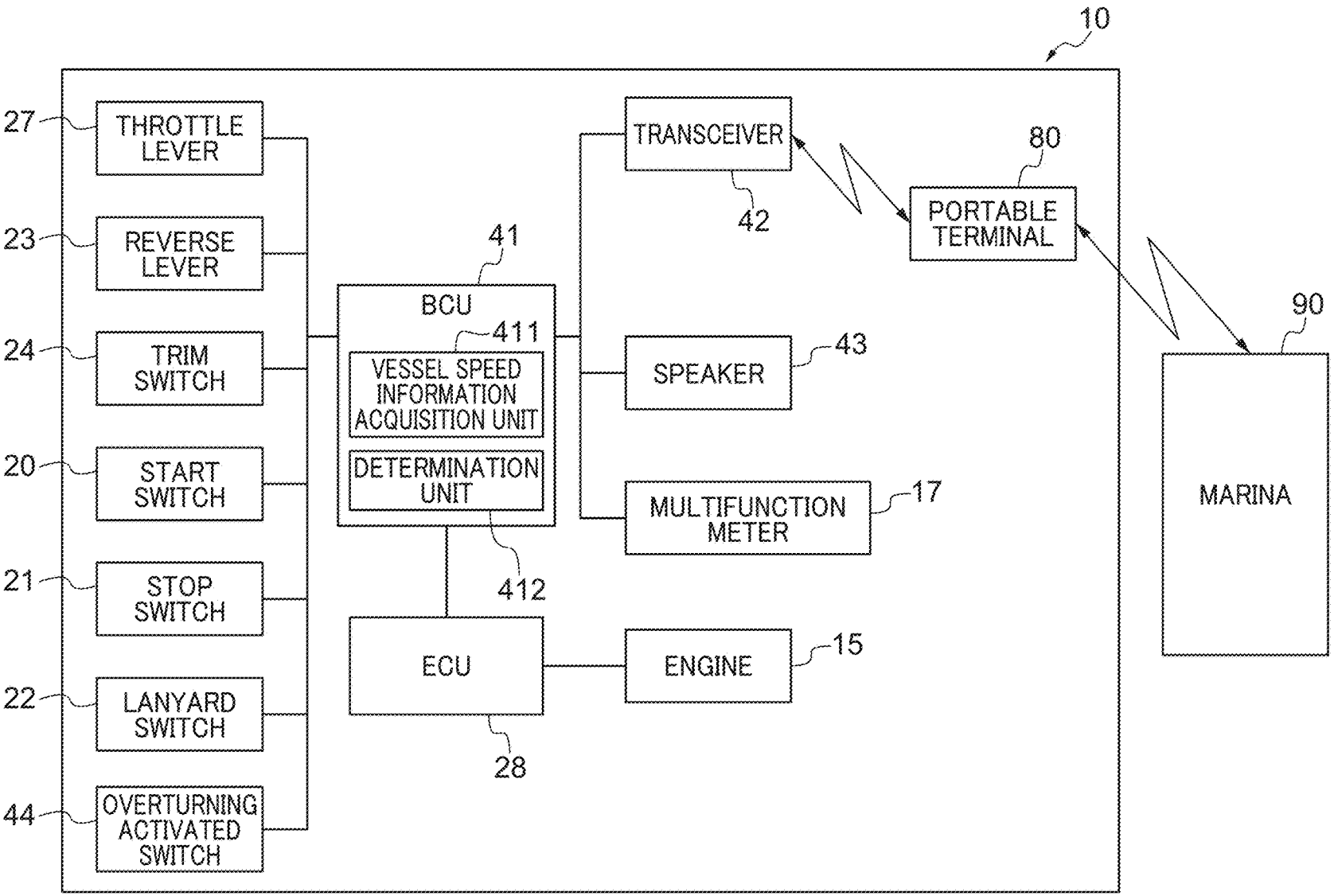
FIG. 4 is a block diagram schematically illustrating a control system configuration of the marine vessel illustrated in FIG. 1.

FIG. 4 is a block diagram schematically illustrating a control system configuration of the marine vessel 10 illustrated in FIG. 1. As illustrated in FIG. 4, the marine vessel 10 includes, in addition to the above-described operators such as the start switch 20, a boat control unit (BCU) 41, a transceiver 42, a speaker 43, an overturned activated switch 44, and an ECU 28, wherein these components are communicably connected to each other.

The BCU 41 is a controller to control each component included in the marine vessel 10. The BCU 41 stores various programs and the like. The programs are not particularly limited to and include, for example, programs to cause a computer to execute operation of each component of the marine vessel 10 (a method for controlling the marine vessel). The transceiver 42 is a communication device communicably connected to a marina 90 via a portable terminal 80, and is fixed to the hull 11 in advance.

In the present preferred embodiment, the transceiver 42 includes a cellular data communication module (hereinafter, referred to as a "data communication module (DCM)") which is a communication terminal. The DCM is a module able to perform wireless communication conforming to a predetermined communication standard, and for example, can perform communication conforming to the "International Mobile Telecommunication (IMT)-Advanced" standard (so-called 4G standard) defined by the International Telecommunication Union (ITU) or communication conforming to the "IMT-2020" standard (so-called 5G standard). Note that the DCM may be a communication module that performs communication conforming to a communication standard other than the above-described communication standards. The speaker 43 emits various sounds such as a warning sound and a voice in accordance with a command from the BCU 41, and is disposed, for example, adjacent to the multifunction meter 17. The overturned activated switch 44 detects overturning of the hull 11 and stops the operation of the engine 15 according to the detection result. An acceleration sensor, a vibration sensor, or the like built in the hull 11 can be used as the overturned activated switch 44, for example.

The ECU 28 is connected to the engine 15 and controls the engine 15. The ECU 28 controls the rotation speed of the engine 15. The engine 15 rotates an impeller (not illustrated) of the jet propulsion device 12, and the rotating impeller generates a water flow to be ejected from the jet nozzle 12*a*.

Therefore, the ECU 28 controls the rotation speed of the engine 15 to control a flow rate of the water flow to be ejected from the jet nozzle 12*a*, thus controlling the vessel speed of the marine vessel 10. The ECU 28 is also connected, via the BCU 41, to the start switch 20, the stop switch 21, the lanyard switch 22, the reverse lever 23 (described above), the trim switch 24 (described above), the overturned activated switch 44, and the throttle lever 27. The ECU 28 receives a signal emitted when each operator is operated, and implements the operation of the engine 15 according to the signal.

For example, when the start switch 20 is operated (pressed) and transmits an engine start signal to the ECU 28, the ECU 28 starts the engine 15. When the stop switch 21 is operated (pressed) and transmits an engine stop signal to the ECU 28, the ECU 28 stops the engine 15. When the hook 26 is detached from the lanyard switch 22 and the lanyard switch 22 is operated and transmits an engine emergency stop signal to the ECU 28, the ECU 28 urgently stops the engine 15. When the hull 11 overturns and the overturned activated switch 44 is operated and transmits an engine stop signal to the ECU 28, the ECU 28 stops the engine 15. When the throttle lever 27 is operated (pulled) and transmits a throttle opening signal corresponding to the operation amount to the ECU 28, the ECU 28 adjusts the throttle opening of the engine 15 to control the rotation speed of the engine 15. In the marine vessel 10, the ECU 28 may have the function of the BCU 41 described above, that is, the ECU 28 may control each component such as the transceiver 42 included in the marine vessel 10.

As illustrated in FIG. 4, the marine vessel 10 (hull 11) is provided with a portable terminal 80 which can be carried by the vessel operator when mounted thereon. The portable terminal 80 may be, for example, a multifunctional portable terminal able to use a plurality of applications such as a global positioning system (GPS) function, for example, a smartphone. The portable terminal 80 is also used as a signal transmission device to transmit a signal for rescue (hereinafter, referred to as a "rescue signal") to the marina 90 when the vessel operator falls in the water. At this time, in the portable terminal 80, the BCU 41 performs a control to forcibly transmit the rescue signal via the transceiver 42.

Note that a transmission destination of the rescue signal is the marina 90 in the present preferred embodiment, but is not limited thereto, and may be, for example, a rental dealer who rents the marine vessel 10, a companion of the vessel operator, or the like. In a case where a plurality of transmission destinations of the rescue signal are stored in the portable terminal 80, a desired transmission destination can be selected from these transmission destinations. The portable terminal 80 can also collectively transmit the rescue signal to the plurality of transmission destinations. The transmission destination of the rescue signal is not limited to the one stored in the portable terminal 80, and may be stored in, for example, a cloud server. The portable terminal 80 is housed in a waterproof case (not illustrated) provided in the hull 11 while the vessel operator is maneuvering the marine vessel 10.

As described above, the marine vessel 10 includes the stop switch 21, the lanyard switch 22, and the overturned activated switch 44. As will be described below, the marine vessel 10 determines whether or not rescue is necessary based on an operation state of each switch, and transmits the rescue signal in a case where it is determined that rescue is necessary. In some situations, even in a case where the engine 15 is stopped due to operation of the lanyard switch 22 or the overturned activated switch 44, when the marine vessel 10 is navigating at a relatively low speed, the marine vessel 10 is not so far away from the vessel operator who has fallen in the water, and thus the vessel operator who has fallen in the water may be able to quickly return to the marine vessel 10. In this case, rescue is unnecessary. However, in a conventional art, the rescue signal may be transmitted regardless of whether or not the vessel operator can quickly return to the marine vessel 10 (necessity of rescue). In contrast, the marine vessel 10 according to the present preferred embodiment is configured to improve the appropriateness of transmitting a rescue signal as described below.

As illustrated in FIG. 4, the BCU 41 includes a vessel speed information acquisition unit 411 and a determination unit 412. The vessel speed information acquisition unit 411 acquires vessel speed information regarding the vessel speed of the hull 11 (vessel speed information acquisition step). In a case where the operation of the engine 15 is stopped, the determination unit 412 determines whether or not rescue is necessary based on the vessel speed information (determination step). As described above, the portable terminal 80 includes the GPS function. The vessel speed information acquisition unit 411 acquires the vessel speed information from the portable terminal 80 (GPS) via the transceiver 42. The vessel speed information acquisition unit 411 can also acquire the vessel speed information based on the rotation speed of the engine 15 obtained from the ECU 28.

For example, the BCU 41 stores in advance a calibration curve indicating a relationship between the rotation speed of the engine 15 and the vessel speed of the hull 11, and the vessel speed information acquisition unit 411 can obtain the vessel speed of the hull 11 from the rotation speed of the engine 15 by using the calibration curve. Therefore, the vessel speed information may be the vessel speed itself directly obtained from the portable terminal 80 or the rotation speed of the engine 15. The vessel speed information acquisition unit 411 can switch between obtaining the vessel speed information from the portable terminal 80 and obtaining the vessel speed information from the ECU 28, according to various conditions such as a communication state of the portable terminal 80 and/or whether or not the engine 15 is operating. Since the portable terminal 80 is housed in the waterproof case of the hull 11 while the vessel operator is maneuvering, the position information of the portable terminal 80 can be used as the position information of the hull 11. The position information of the hull 11 is acquired by the vessel speed information acquisition unit 411 together with the vessel speed information.

Figure 5:
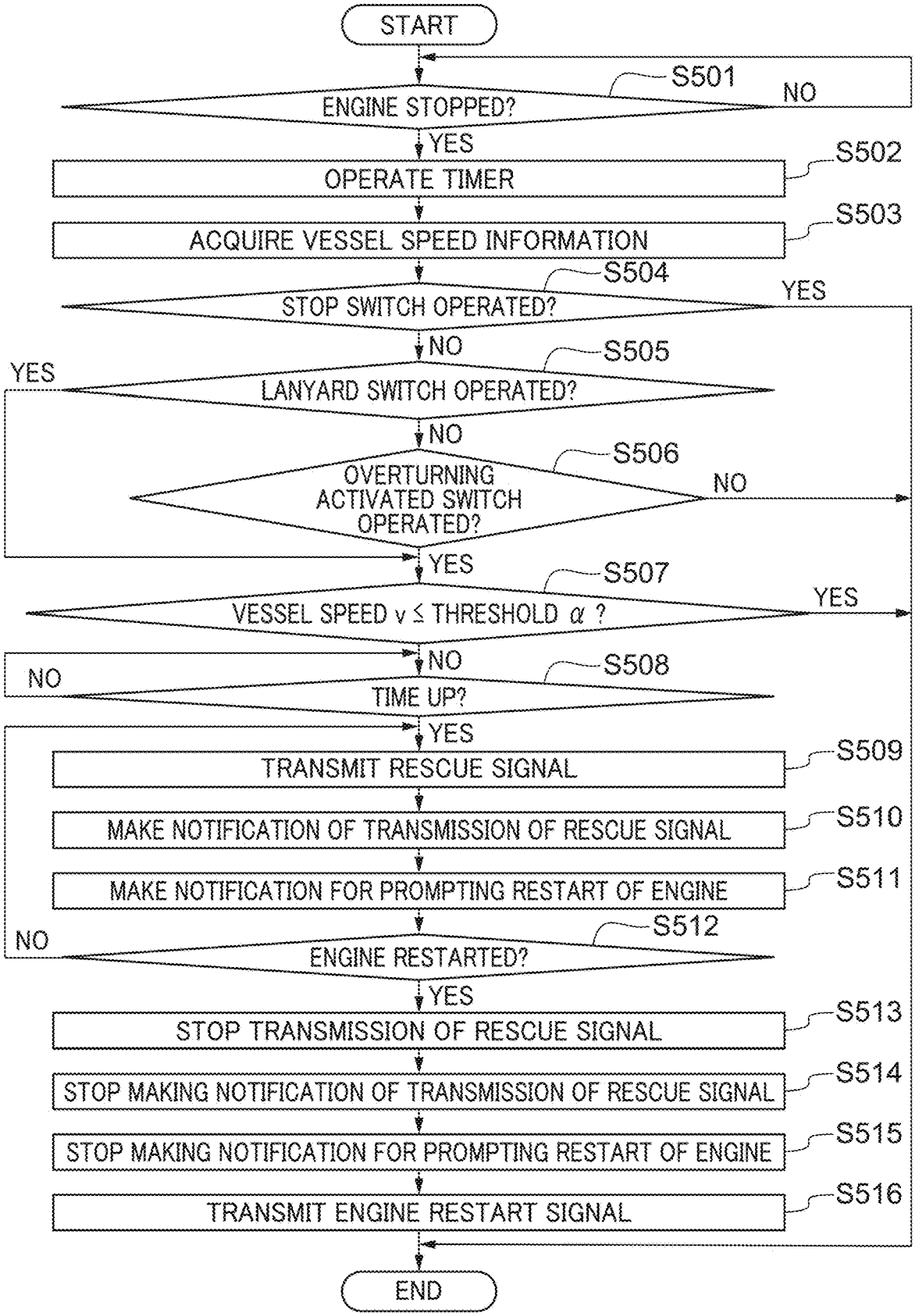
FIG. 5 is a flowchart illustrating a control program executed in the marine vessel illustrated in FIG. 1.
Figure 6:
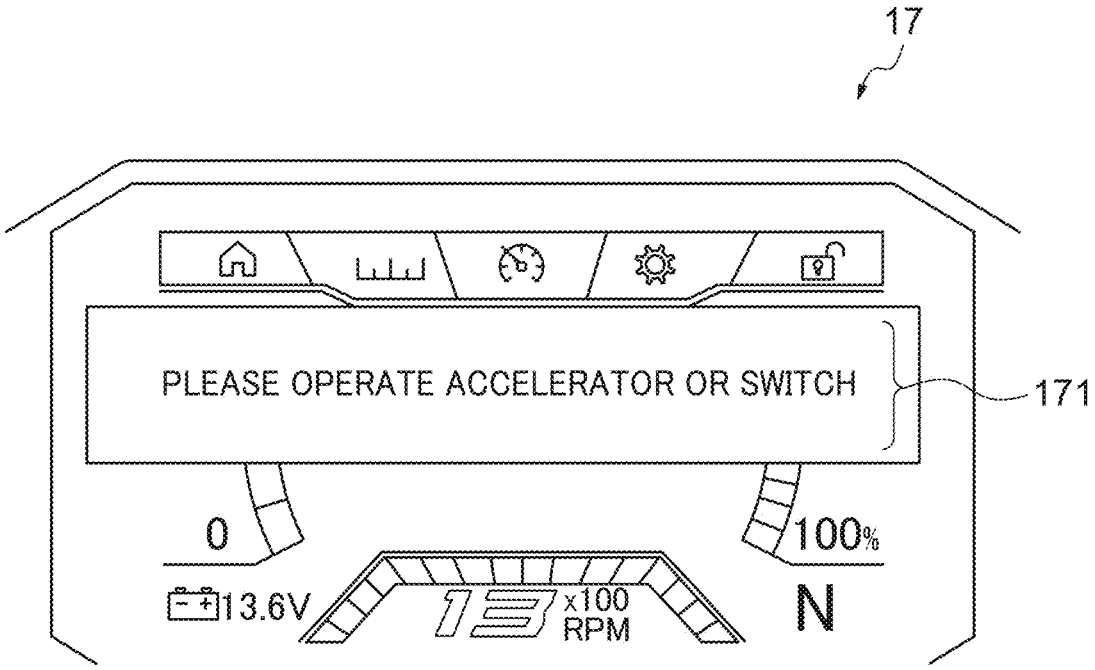
FIG. 6 is a diagram of a display example (an example of a notification to prompt a restart operation) to be displayed on a multifunction meter of the marine vessel illustrated in FIG. 1.

FIG. 5 is a flowchart illustrating a control program executed in the marine vessel 10 illustrated in FIG. 1. The flowchart illustrated in FIG. 5 includes processes from detection of the stop of the engine 15 to requesting rescue. FIG. 6 is a diagram of a display example (an example of a notification to prompt a restart operation) to be displayed on the multifunction meter of the marine vessel 10 illustrated in FIG. 1.

Referring to FIG. 5, in step S501, the BCU 41 determines whether or not the operation of the engine 15 is stopped. In a case where the BCU 41 determines in step S501 that the engine 15 is stopped, the process proceeds to step S502. In a case where the BCU 41 determines in step S501 that the engine 15 is not stopped, step S501 is repeated.

In step S502, the BCU 41 operates a timer (not illustrated) built in the BCU 41. In step S503, the BCU 41 causes the vessel speed information acquisition unit 411 to acquire the vessel speed information. As described above, the vessel speed directly obtained from the portable terminal 80 or the rotation speed of the engine 15 can be used as the vessel speed information, and here, the vessel speed (hereinafter referred to as "vessel speed v") is used. The vessel speed v is a vessel speed immediately after the engine 15 is stopped. The vessel speed information acquisition unit 411 also acquires the position information of the hull 11 from the portable terminal 80.

In step S504, the BCU 41 causes the determination unit 412 to determine whether or not the stop switch 21 has operated, that is, whether or not the engine 15 is stopped by the vessel operator manually operating the stop switch 21. In a case where the determination unit 412 determines in step S504 that the stop of the engine 15 is caused by the operation of the stop switch 21, the determination unit 412 determines that rescue is unnecessary, and the process ends. The stop of the engine 15 by the operation of the stop switch 21 is the stop of the engine 15 in a normal operation of the marine vessel 10. On the other hand, in a case where the determination unit 412 determines in step S504 that the stop of the engine 15 is not caused by the operation of the stop switch 21, the process proceeds to step S505.

In step S505, the BCU 41 causes the determination unit 412 to determine whether or not the lanyard switch 22 has operated, that is, whether or not the engine 15 is stopped by the lanyard switch 22. In a case where the determination unit 412 determines in step S505 that the engine 15 is stopped by the lanyard switch 22, the process proceeds to step S507. In a case where it is determined that the engine 15 is stopped by the lanyard switch 22, rescue may be necessary. On the other hand, in a case where the determination unit 412 determines in step S505 that the engine 15 is not stopped by the lanyard switch 22, the process proceeds to step S506.

In step S506, the BCU 41 causes the determination unit 412 to determine whether or not the overturned activated switch 44 has operated, that is, whether or not the engine 15 is stopped by the overturned activated switch 44. In a case where the determination unit 412 determines in step S506 that the engine 15 is stopped by the overturned activated switch 44, the process proceeds to step S507. In a case where it is determined that the engine 15 is stopped by the overturned activated switch 44, rescue may be necessary. On the other hand, in a case where the determination unit 412 determines in step S506 that the engine 15 is not stopped by the overturned activated switch 44, the determination unit 412 determines that the rescue is unnecessary, and the process ends.

In step S507, the BCU 41 causes the determination unit 412 to determine whether or not the vessel speed v acquired in step S503 is a low speed, that is, whether or not the vessel speed v is equal to or less than a predetermined threshold $\alpha$ (vessel speed v threshold $\alpha$). As described above, the vessel speed v is the vessel speed immediately after the engine 15 is stopped. In a case where the vessel speed v is equal to or less than the threshold $\alpha$, it is considered that even if the vessel operator falls in the water at the time of maneuvering the marine vessel 10, the vessel operator does not get so far from the marine vessel 10 and can quickly return to the marine vessel 10 and resume maneuvering. The threshold $\alpha$ is preferably, for example, $\alpha$=15 km/h, and more preferably 0 to about 10 km/h (0 km/h$\leq\alpha\leq$10 km/h). The threshold $\alpha$ is stored in the BCU 41 in advance. The threshold $\alpha$ in a case where the rotation speed of the engine 15 is used as the vessel speed information is, for example, preferably $\alpha$=3000 rpm, and more preferably $\alpha$=2000 rpm.

Then, in a case where the determination unit 412 determines in step S507 that the vessel speed v is equal to or less than the threshold $\alpha$, it is determined that rescue is unnecessary, and the process ends. On the other hand, in a case where the determination unit 412 determines in step S507 that the vessel speed v is not equal to or less than the threshold $\alpha$ (the vessel speed v exceeds the threshold $\alpha$), the process proceeds to step S508. In a case where it is determined that the vessel speed v is not equal to or less than the threshold $\alpha$, rescue may be necessary.

In step S508, the BCU 41 causes the determination unit 412 to determine whether or not a predetermined period of time has elapsed after the engine 15 is stopped (whether or not the time is up) based on the count of the timer operated in step S502. In step S508, in a case where the determination unit 412 determines that the time is up, the process proceeds to step S509. On the other hand, in a case where the determination unit 412 determines in step S508 that the time is not up, the BCU 41 repeats step S508. A period of time from when the engine 15 is stopped to when the time is up can be set to a period of time in which the vessel operator falls in the water in a state where the marine vessel 10 is at a low speed and then the vessel operator can quickly return to the marine vessel 10. The period of time from when the engine 15 is stopped to when the time is up is preferably, for example, about 180 to about 300 seconds, and more preferably about 200 to about 300 seconds. In a case where it is determined in step S508 that the time is up, the determination unit 412 determines that rescue is necessary. Note that the multifunction meter 17 may display a period of time until the time is up.

In step S509, the BCU 41 controls the portable terminal 80 via the transceiver 42 to transmit the rescue signal. As a result, the rescue signal is transmitted to the marina 90, and rescue is requested. The rescue signal includes the position information of the hull 11 acquired in step S503. As a result, the position information of the hull 11 is also transmitted to the marina 90, and it is possible, at the marina 90 to know the position of the hull 11 when the rescue is requested.

In step S510, the BCU 41 operates the speaker 43 and makes a sound to notify that the rescue signal has been transmitted. In this way, in the present preferred embodiment, in a case where the BCU 41 has transmitted the rescue signal, the speaker 43 functions as a notifier to confirm that the rescue signal has been transmitted. As a result, the vessel operator who has fallen in the water can know that a rescue request is being made or has been made. The sound emitted from the speaker 43 is not particularly limited, and may be, for example, various warning sounds, such as a voice saying "rescue requested", or the like.

In step S511, the BCU 41 operates the multifunction meter 17 to wait for a re-operation by the vessel operator (FIG. 6). The multifunction meter 17 in the re-operation waiting state displays a message 171 to prompt the vessel operator to perform a re-operation, for example, a restart of the engine, completion of re-boarding, etc. The message 171 includes, for example, a message "Please operate the accelerator" to prompt the operation of the throttle lever 27, a message "Please operate the switch" to prompt the operation of the start switch 20, and the like. In a case where the vessel operator returns to the marine vessel 10 and visually recognizes the message 171, the vessel operator can restart the marine vessel 10 according to the message 171. As described above, in the present preferred embodiment, the multifunction meter 17 functions as a restart notifier that makes a notification to prompt restart, i.e., a re-operation. Similarly to the multifunction meter 17, the speaker 43 can also be used as the restart notifier.

In step S512, the BCU 41 determines whether or not the engine 15 is restarted by the re-operation. In step S512, in a case where the BCU 41 determines that the engine 15 is restarted, the process proceeds to step S513. Accordingly, it is estimated that the re-boarding is completed. On the other hand, in a case where the BCU 41 determines in step S512 that the engine 15 is not restarted, the process returns to step S509, and the processes in and after step S509 are sequentially executed. As a result, the rescue signal is repeatedly transmitted to the portable terminal 80 until the engine 15 is restarted, and the rescue request to the marina 90 can be continued.

In step S513, the BCU 41 switches the determination that rescue is necessary (the determination made in a case where the time is up in step S508) to the determination that rescue is unnecessary, and performs a control in the portable terminal 80 to stop rescue signal transmission. In step S514, the BCU 41 stops the operation of the speaker 43 to stop the warning sound or voice which is being emitted from the speaker 43. In step S515, the BCU 41 stops displaying the message 171 on the multifunction meter 17.

In step S516, the BCU 41 controls the portable terminal 80 to transmit a signal indicating that the restart operation has been performed to the marina 90. As a result, it is possible, at the marina 90, to recognize that the vessel operator has re-boarded the marine vessel.

The first preferred embodiment has been described above. Even in a case where the engine 15 is stopped by the operation of the lanyard switch 22 or the overturned activated switch 44, when the marine vessel 10 is navigating at the vessel speed v equal to or less than the threshold $\alpha$, the vessel operator who has fallen in the water may be able to quickly return to the marine vessel 10. In the present preferred embodiment, in this case, it is possible to determine that rescue is unnecessary, and thus a rescue signal is not transmitted. On the other hand, in a case where the vessel operator falls in the water in a state in which the marine vessel 10 is navigating at the vessel speed v exceeding the threshold $\alpha$, the rescue signal is transmitted. As a result, in the marine vessel 10 of the present preferred embodiment, it is possible to improve the appropriateness of transmitting the rescue signal.

Some vessel operators, when docking the marine vessel 10, bring the engine 15 into an idling state instead of stopping the engine 15 by the stop switch 21, and pull the lanyard 25 to stop the engine 15 by the lanyard switch 22. In this case, it is obvious that the vessel speed v when the engine 15 is stopped is equal to or less than the threshold $\alpha$, and an unnecessary rescue signal is not transmitted even if the process of FIG. 5 is executed. In addition, the marine vessel 10 can transmit the rescue signal regardless of the navigation place as long as communication with the marina 90 is possible, and the vessel operator can continue to enjoy maneuvering the marine vessel 10.

As described above, in step S503, the position information of the hull 11 is acquired. The position information is acquired a plurality of times over time. Thus, the BCU 41 (detection unit) can detect (calculate) at least one of a moving direction of the hull 11 or a moving speed of the hull 11 based on at least two pieces of position information. When performing a control to transmit the rescue signal in step S509, the BCU 41 includes, in the rescue signal, the detection result, that is, information regarding the moving direction or the moving speed of the hull 11. As a result, at the marina 90, the moving direction of the hull 11 is estimated as a direction in which the vessel operator who has fallen in the water is carried away, and the moving speed of the hull 11 is estimated as a speed at which the vessel operator who has fallen in the water is carried away, which can be used as a reference for the rescue activity.

Note that, in the marine vessel 10, the process of step S507 may be executed between steps S503 and S504, for example. Further, the threshold $\alpha$ (see step S507) and the period of time from when the engine 15 is stopped to when the time is up (see step S508) may be changeable. As a result, for example, the threshold $\alpha$ and the period of time until the time is up can be appropriately changed according to a marine situation such as the flow of the tide and the wind speed, and the navigation conditions such as the type of the marine vessel 10. Further, an upper limit may be set for the period of time until the time is up, which makes it possible to prevent the execution timing of step S509, that is, the transmission of the rescue signal from being delayed.

Figure 7:
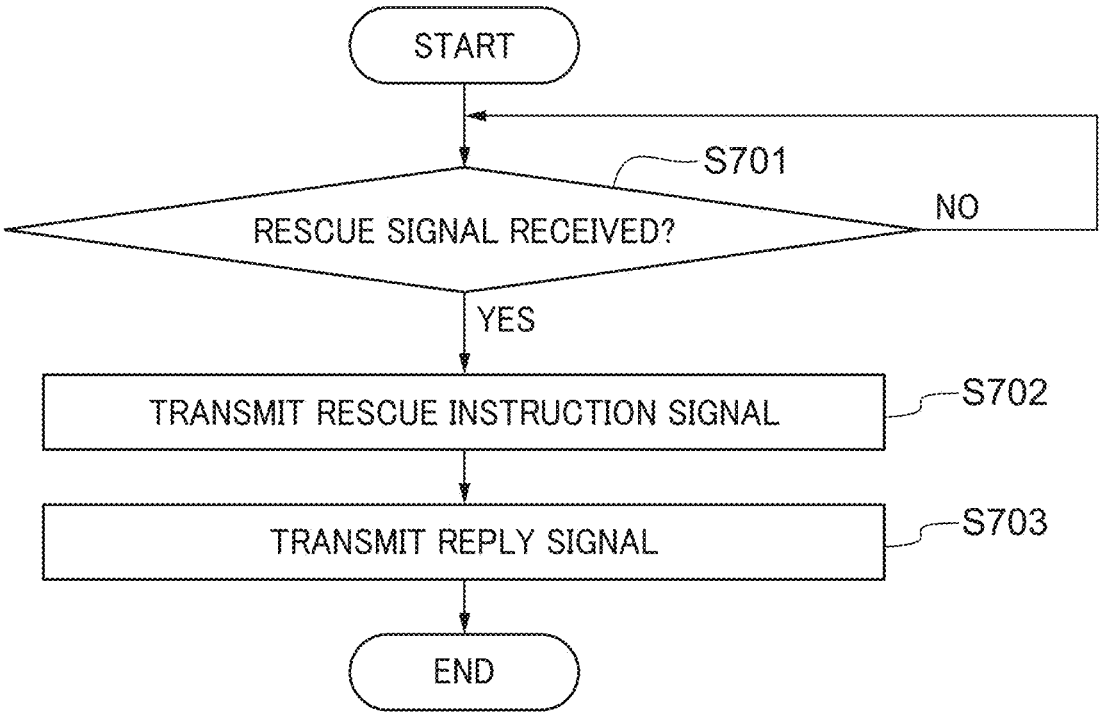
FIG. 7 is a flowchart illustrating a control program executed at a marina.

FIG. 7 is a flowchart illustrating a control program executed at the marina 90. In step S701, the marina 90 determines whether or not the marina 90 has received the rescue signal from the marine vessel 10. In a case where it is determined in step S701 that the marina 90 has received the rescue signal, the process proceeds to step S702. On the other hand, in a case where it is determined in step S701 that the marina 90 has not received the rescue signal, the process of step S701 is repeated.

In step S702, the marina 90 transmits a rescue instruction signal to instruct a rescue to other vessels and the like in a sea area where the marine vessel 10 is estimated to be. The rescue instruction signal includes information such as the position information, the moving direction, and the moving speed, of the hull 11 (marine vessel 10). As a result, the other marine vessel that has received the rescue instruction signal can move to rescue the vessel operator who has fallen in the water.

In step S703, the marina 90 transmits, to the marine vessel 10, a reply signal indicating that the rescue signal has been received in step S701. The marine vessel 10 receives the reply signal by the transceiver 42. Then, the BCU 41 of the marine vessel 10 operates the speaker 43 to notify that the reply signal from the marina 90 has been received by sound. As a result, the vessel operator who has fallen in the water can recognize that the rescue signal has reached the marina 90. Note that the notification sound to be emitted in step S703 is different from the sound to be emitted in step S510.

Figure 8:
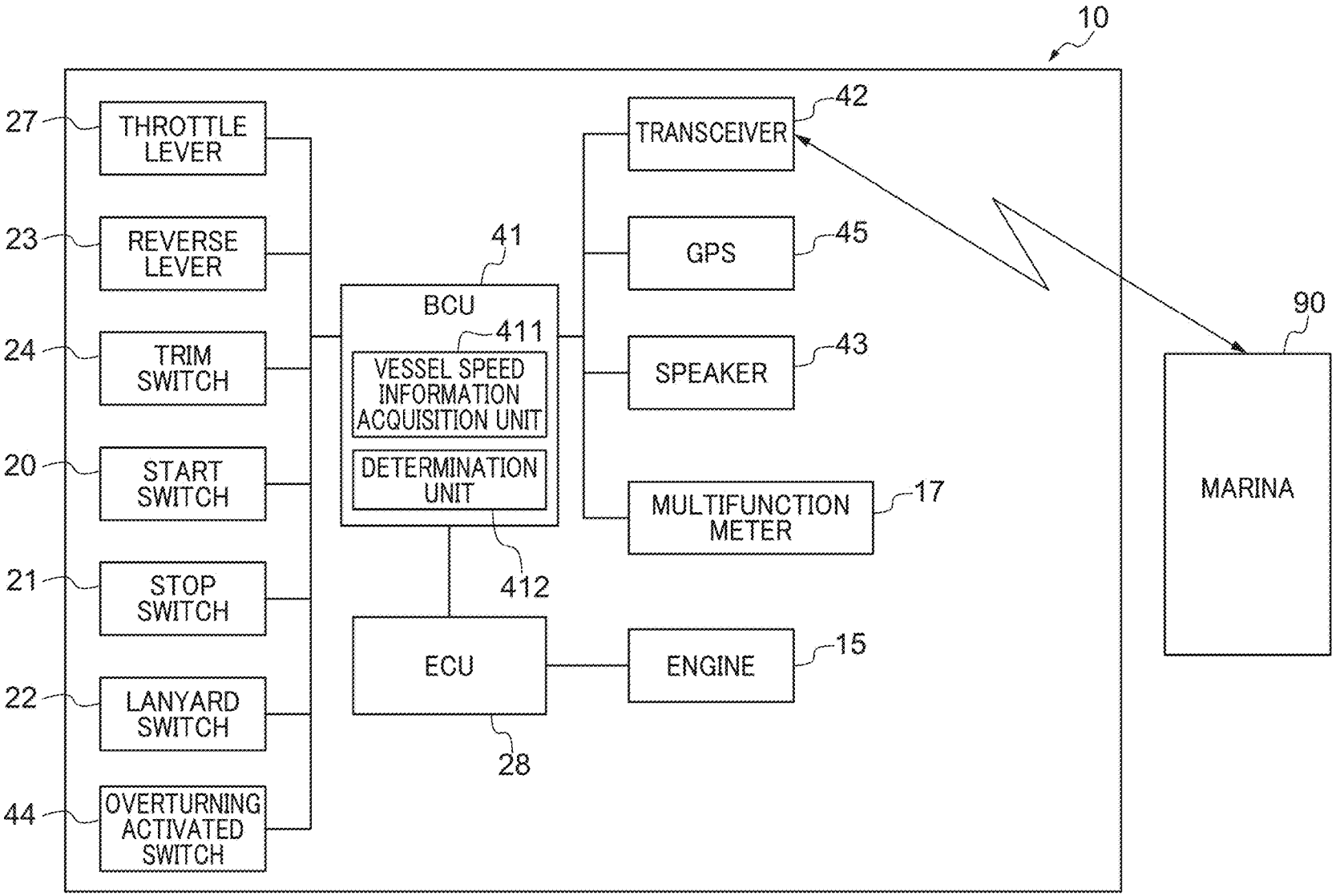
FIG. 8 is a block diagram schematically illustrating a control system configuration of a marine vessel according to a second preferred embodiment of the present invention.

A second preferred embodiment of the present invention will be described with reference to FIG. 8. Differences from the first preferred embodiment will be mainly described, and a description of matters similar to those of the first preferred embodiment will be omitted. FIG. 8 is a block diagram schematically illustrating a control system configuration of a marine vessel 10 according to the second preferred embodiment. The marine vessel 10 of the second preferred embodiment is not provided with a portable terminal 80. The marine vessel 10 of the second preferred embodiment further includes a GPS 45. The GPS 45 acquires the current position of the marine vessel 10 and transmits position information of the current position to a BCU 41. A vessel speed information acquisition unit 411 can acquire the position information of the marine vessel 10. As described above, a transceiver 42 is a DCM fixed to the hull 11 in advance. In the present preferred embodiment, the transceiver 42 is used as a signal transmission device that transmits a rescue signal to the marina 90. As a result, the marine vessel 10 can transmit the rescue signal even in a case where the portable terminal 80 is not mounted, and the rescue request to the marina 90 can be made. In addition, the marine vessel 10 of the present preferred embodiment can also appropriately transmit the rescue signal.

A modification of the preferred embodiments will be described. In the above-described preferred embodiments, the marine vessel 10 is a saddle-riding type small marine vessel, that is, a small planing boat (PWC). However, the marine vessel 10 may be a bus boat. In a case where the marine vessel 10 is a bus boat, the bus boat hardly overturns, and thus, the overturned activated switch 44 is unnecessary. Therefore, in a case where the marine vessel 10 is a bus boat, the process related to the overturned activated switch 44 in the flowchart illustrated in FIG. 5 can be omitted. The marine vessel 10 having such a configuration can also improve the appropriateness of transmitting the rescue signal.

Although preferred embodiments of the present invention have been described above, the present invention is not limited to the above-described preferred embodiments, and various modifications and changes can be made within the scope of the gist of the present invention. Although the marine vessel 10 includes the jet propulsion device 12 including the engine 15, the present invention is not limited thereto. For example, the marine vessel 10 may include the jet propulsion device 12 including an electric motor, and the marine vessel 10 may include the jet propulsion device 12 including both the engine 15 and the electric motor.

Further, preferred embodiments of the present invention may also be implemented by processes in which a program that implements one or more functions of the above-described preferred embodiments is supplied to a system or device via a network or storage medium, and one or more processors in a computer of the system or device read and execute the program. Further, preferred embodiments of the present invention may also be implemented by a circuit (for example, an application-specific integrated circuit (ASIC)) that implements one or more functions.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel including:

a hull;

a propulsion force generator to generate a propulsion force to propel the hull; and a controller configured or programmed to:

acquire vessel speed information regarding a vessel speed of the hull; and determine whether or not rescue is necessary based on the vessel speed information in a case where operation of the propulsion force generator is stopped.

2. The marine vessel according to claim 1, wherein the controller is configured or programmed to determine that the rescue is unnecessary in a case where the vessel speed is equal to or less than a predetermined threshold, and determine that the rescue is necessary in a case where the vessel speed exceeds the predetermined threshold.

3. The marine vessel according to claim 2, wherein the controller is configured or programmed to determine that the rescue is necessary in a case where the vessel speed exceeds the predetermined threshold and a predetermined period of time has elapsed after the operation of the propulsion force generator is stopped.

4. The marine vessel according to claim 3, wherein the predetermined period of time is changeable according to a navigation condition.

5. The marine vessel according to claim 2, wherein the hull includes a signal transmitter to transmit a signal for the rescue; and the controller is configured or programmed to control the signal transmitter to transmit the signal for the rescue when it is determined that the rescue is necessary.

6. The marine vessel according to claim 5, wherein the controller is configured or programmed to control the signal transmitter to repeatedly transmit the signal for the rescue.

7. The marine vessel according to claim 5, wherein the signal for the rescue includes position information of the hull.

8. The marine vessel according to claim 7, wherein the controller is configured or programmed to detect at least one of a moving direction of the hull or a moving speed of the hull based on at least two pieces of the position information; and when the signal transmitter transmits the signal for the rescue, the controller is configured or programmed to include in the signal for the rescue information regarding a result of the detection.

9. The marine vessel according to claim 5, further comprising:

a notifier to provide a notification; wherein when the controller controls the signal transmitter to transmit the signal for the rescue, the notifier is operable to notify that the signal for the rescue has been transmitted.

10. The marine vessel according to claim 5, wherein the signal transmitter is portable or fixed to the hull in advance.

11. The marine vessel according to claim 1, further comprising:

a manual stop switch to stop the operation of the propulsion force generator in response to a manual operation; and a lanyard switch to stop the operation of the propulsion force generator in response to disconnection of a lanyard from the hull; wherein the controller is configured or programmed to determine that the rescue is unnecessary in a case where the operation of the propulsion force generator is stopped by the manual stop switch, and determine that the rescue is necessary in a case where the operation of the propulsion force generator is stopped by the lanyard switch.

12. The marine vessel according to claim 11, further comprising:

an overturned activated switch to stop the operation of the propulsion force generator in response to the hull being overturned; wherein the controller is configured or programmed to determine that the rescue is necessary in a case where the operation of the propulsion force generator is stopped by the overturned activated switch.

13. The marine vessel according to claim 1, further comprising an operator operable to wait to be operated by a passenger in a case where the controller determines that the rescue is necessary.

14. The marine vessel according to claim 13, wherein the operator is operable to prompt the passenger to operate the operator.

15. The marine vessel according to claim 13, wherein the controller is configured or programmed to switch a determination that the rescue is necessary to a determination that the rescue is unnecessary in a case where the operator is operated.

16. The marine vessel according to claim 15, wherein the hull includes a signal transmitter to transmit a signal for the rescue; and the controller is configured to control the signal transmitter to transmit the signal for the rescue in a case where it is determined that the rescue is necessary, and control the signal transmitter to stop transmitting the signal for the rescue in a case where the determination that the rescue is necessary is switched to the determination that the rescue is unnecessary.

17. The marine vessel according to claim 16, wherein the controller is configured or programmed to control the signal transmitter to transmit a signal indicating that a restart operation has been performed on the operation unit when the signal transmitter stops transmitting the signal for the rescue.

18. The marine vessel according to claim 1, wherein the controller is configured or programmed to acquire the vessel speed information from a global positioning system.

19. The marine vessel according to claim 1, wherein the propulsion force generator includes an engine; and the controller is configured or programmed to acquire the vessel speed information from a global positioning system, or acquire the vessel speed information based on a rotation speed of the engine.

20. A method for controlling a marine vessel including a hull and a propulsion force generator to generate a propulsion force to propel the hull, the method comprising:

acquiring vessel speed information regarding a vessel speed of the hull; and determining whether or not rescue is necessary based on the vessel speed information in a case where operation of the propulsion force generator is stopped.

* * * * *